US011120956B1

(12) United States Patent
Chang et al.

(10) Patent No.: US 11,120,956 B1
(45) Date of Patent: Sep. 14, 2021

(54) KEYBOARD DEVICE

(71) Applicant: Primax Electronics Ltd., Taipei (TW)

(72) Inventors: Chia-Wei Chang, Taipei (TW); Chin-Sung Pan, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/031,735

(22) Filed: Sep. 24, 2020

(30) Foreign Application Priority Data

Jul. 24, 2020 (TW) ..... 109125151

(51) Int. Cl.
*H01H 3/12* (2006.01)
*H01H 13/7057* (2006.01)
*H01H 13/704* (2006.01)
*H01H 13/7073* (2006.01)

(52) U.S. Cl.
CPC ..... *H01H 13/7057* (2013.01); *H01H 3/125* (2013.01); *H01H 13/704* (2013.01); *H01H 13/7073* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS

| | | | | |
|---|---|---|---|---|
| 10,109,437 | B1 * | 10/2018 | Li | H01H 13/85 |
| 2017/0213663 | A1 * | 7/2017 | Jhuang | H01H 3/125 |
| 2018/0137997 | A1 * | 5/2018 | Wang | H01H 3/125 |
| 2019/0252136 | A1 * | 8/2019 | Wu | H01H 3/125 |

* cited by examiner

*Primary Examiner* — Ahmed M Saeed
(74) *Attorney, Agent, or Firm* — Kirton McConkie; Evan R Witt

(57) ABSTRACT

A keyboard device includes a key structure and a membrane circuit board. The membrane circuit board includes a membrane switch. The membrane switch is located under the key structure. The key structure includes a pedestal structure, a covering structure, a keycap, a connecting element, a dome-type elastomer and a knocking element. The keycap is installed on the covering structure. The connecting element is connected between the covering structure and the pedestal structure. The dome-type elastomer is arranged between the covering structure and the membrane circuit board. When the keycap is not depressed, the knocking element is supported on the connecting element. While the keycap is depressed, the knocking element knocks on the connecting element to generate an operating sound and provide the operating feedback to the user.

9 Claims, 15 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users pay much attention to the keyboard devices.

Hereinafter, the structure and function of a conventional keyboard device with a mechanical key structure will be described with reference to FIGS. 1 and 2. FIG. 1 is a schematic cross-sectional view illustrating a conventional keyboard device with a mechanical key structure. FIG. 2 is a schematic cross-sectional view illustrating the mechanical switch of the conventional keyboard device of FIG. 1, in which a keycap of the mechanical key structure is depressed. For succinctness, only one mechanical key structure and associated components are shown in FIGS. 1 and 2. The keyboard device 2 comprises plural mechanical key structures 22 and a circuit board 21. Each mechanical key structure 22 comprises a keycap 221 and a mechanical switch 224. The mechanical switch 224 is arranged between the keycap 221 and the circuit board 21. The mechanical switch 224 comprises a casing 2241, a push element 2242, a linkage element 2243, a first spring strip 2244, a second spring strip 2245 and an elastic element 2246. The linkage element 2243, the elastic element 2246, at least a part of the push element 2242, at least a part of the first spring strip 2244 and at least a part of the second spring strip 2245 are accommodated within the casing 2241.

The casing 2241 comprises a pedestal 22411 and an upper cover 22412. The pedestal 22411 is covered by the upper cover 22412. Moreover, the upper cover 22412 has an upper cover opening. A first end of the push element 2242 is penetrated through the upper cover opening and contacted with the keycap 221. A second end of the push element 2242 is disposed within the casing 2241 and connected with the linkage element 2243. The linkage element 2243 is located at a middle region of the pedestal 22411. Moreover, the linkage element 2243 is movable upwardly or downwardly relative to the pedestal 22411. The linkage element 2243 has a protrusion structure 22431. The protrusion structure 22431 is extended from a sidewall of the linkage element 2243 and toward the first spring strip 2244. The elastic element 2246 is located under the linkage element 2243. A first end of the elastic element 2246 is connected with the linkage element 2243. A second end of the elastic element 2246 is fixed on the pedestal 22411. Moreover, the elastic element 2246 provides an elastic force to the linkage element 2243.

The first spring strip 2244 is located near a sidewall of the pedestal 22411. The first spring strip 2244 comprises a first electric connection part 22441, an elastic part 22442 and a first fixing part 22443. The first fixing part 22443 is fixed on the pedestal 22411. Moreover, the first fixing part 22443 is arranged between the first electric connection part 22441 and the elastic part 22442. The elastic part 22442 is disposed within the casing 2241 and contacted with the protrusion structure 22431 of the linkage element 2243. Moreover, the elastic part 22442 can be swung relative to the first fixing part 22443. After the first electric connection part 22441 is penetrated downwardly through the pedestal 22411, the first electric connection part 22441 is contacted and electrically connected with the circuit board 21. The second spring strip 2245 is arranged between the linkage element 2243 and the first spring strip 2244. The second spring strip 2245 comprises a second electric connection part 22451, a conduction part 22452 and a second fixing part 22453. The second fixing part 22453 is fixed on the pedestal 22411. Moreover, the second fixing part 22453 is arranged between the second electric connection part 22451 and the conduction part 22452. The conduction part 22452 is disposed within the casing 2241. After the second electric connection part 22451 is penetrated downwardly through the pedestal 22411, the second electric connection part 22451 is contacted and electrically connected with the circuit board 21.

While the keycap 221 is depressed, the keycap 221 is moved downwardly to push the push element 2242. Since the linkage element 2243 is connected with the push element 2242, the linkage element 2243 is moved downwardly with the push element 2242. At the same time, the elastic element 2246 is compressed to generate the elastic force. As the linkage element 2243 is moved downwardly, the protrusion structure 22431 of the linkage element 2243 is contacted with the elastic part 22442 of the first spring strip 2244. Moreover, the protrusion structure 22431 is moved downwardly relative to the elastic part 22442 so as to push the elastic part 22442. Consequently, the elastic part 22442 is swung relative to the first fixing part 22443. As the linkage element 2243 is continuously moved downwardly, the swung elastic part 22442 correspondingly contacts and collides with the conduction part 22452 of the second spring strip 2245. Meanwhile, as shown in FIG. 2, the first spring strip 2244 and the second spring strip 2245 are in contact with each other. Consequently, the circuit board 21 generates a corresponding key signal.

When the elastic part 22442 of the first spring strip 2244 collides with the conduction part 22452 of the second spring strip 2245, a click sound is generated. Due to the click sound, the user can feel the feedback of depressing the keycap 221. Moreover, when the keycap 221 is no longer depressed, the linkage element 2243 and the push element 2242 are moved upwardly in response to the elastic force of the elastic element 2246. Consequently, the keycap 221 is returned to its original position as shown in FIG. 1. The operations of the mechanical switch 224 are well known to those skilled in the art, and not redundantly described herein. The type of the mechanical switch 224 is not restricted to that of FIGS. 1 and 2.

However, the mechanical switch still has some drawbacks. For example, since the structure of the mechanical switch is complicated, the fabricating cost of the mechanical switch is high. Moreover, it is difficult to reduce the thickness of the keyboard device with the mechanical switch. That is, the keyboard device with the mechanical switch cannot meet the requirements of light weightiness, slimness and small size. For solving these drawbacks, a keyboard device with a membrane switch has been introduced into the market.

Please refer to FIGS. 3 and 4. FIG. 3 is a schematic side view illustrating a conventional keyboard device with a membrane switch. FIG. 4 is a schematic exploded view illustrating a portion of a membrane circuit board of the conventional keyboard device of FIG. 3. The conventional keyboard device 1 comprises a base plate 13, a membrane circuit board 14 and plural key structures 12. Each of the plural key structures 12 comprises a keycap 121, a scissors-type connecting element 122 and an elastic element 123. The scissors-type connecting element 122 is connected between the keycap 121 and the base plate 13. Moreover, the scissors-type connecting element 122 comprises a first frame 1221 and a second frame 1222. The second frame 1222 is pivotally coupled to the first frame 1221. Consequently, the first frame 1221 and the second frame 1222 can be swung relative to each other. The elastic element 123 is arranged between the keycap 121 and the membrane circuit board 14. Moreover, the elastic element 123 comprises a contacting part 1231.

The membrane circuit board 14 comprises an upper film layer 142, a lower film layer 141 and an intermediate film layer 143. The intermediate film layer 143 is arranged between the upper film layer 142 and the lower film layer 141. A first circuit pattern 1421 is formed on a bottom surface of the upper film layer 142. The first circuit pattern 1421 comprises plural upper contacts 14211 corresponding to the plural key structures 12. A second circuit pattern 1411 is formed on a top surface of the lower film layer 141. The second circuit pattern 1411 comprises plural lower contacts 14111 corresponding to the plural upper contacts 14211. In addition, the intermediate film layer 143 comprises plural perforations 1431 corresponding to the plural upper contacts 14211 and the plural lower contacts 14111. Each of the upper contacts 14211 and the corresponding lower contact 14111 are collectively defined as a membrane switch 144.

While the keycap 121 of any key structure 12 is depressed and moved downwardly relative to the base plate 11, the first frame 1221 and the second frame 1222 of the scissors-type connecting element 122 are switched from an open-scissors state to a stacked state. Moreover, as the keycap 121 is moved downwardly to compress the elastic element 123, the corresponding upper contact 14211 is contacted with and triggered by the contacting part 1231 of the elastic element 123. Consequently, the corresponding upper contact 14211 is penetrated through the corresponding perforation 1431 and contacted with the corresponding lower contact 14111. Under this circumstance, the corresponding membrane switch 144 is electrically conducted. When the keycap 121 of the key structure 12 is no longer depressed, the keycap 121 is moved upwardly relative to the base plate 11 in response to an elastic force of the elastic element 123. Meanwhile, the first frame 1221 and the second frame 1222 are switched from the stacked state to the open-scissors state again, and the keycap 121 is returned to its original position.

As mentioned above, the keyboard device with the membrane switch is slim, and the fabricating cost is reduced. However, unlike the mechanical switch, the depressing action on the membrane switch cannot generate the click sound. That is, the user cannot feel the feedback of depressing the keycap. Consequently, the conventional keyboard device needs to be further improved.

SUMMARY OF THE INVENTION

An object of the present invention provides a keyboard device with a key structure. The key structure comprises a keycap, a connecting element and a knocking element. As the keycap is moved downwardly, the knocking element is moved upwardly to knock on the connecting element. Consequently, the keyboard device provides the operating sound and the operating feedback like a mechanical switch. The keyboard device is equipped with a membrane circuit board. Consequently, the keyboard device is slim. The key structure further comprises the dome-type elastomer to support the covering structure and provide the elastic force to the covering structure. Since the keycap is installed on the covering structure, the better periphery tactile feel and stepped operating feel can be provided.

In accordance with an aspect of the present invention, a keyboard device is provided. The keyboard device includes a membrane circuit board and a key structure corresponding to the membrane switch. The membrane circuit board includes a membrane switch. The key structure includes a pedestal structure, a covering structure, a keycap, a connecting element, a knocking element and a dome-type elastomer. The pedestal structure is located over the membrane circuit board. The covering structure is movable upwardly or downwardly relative to the pedestal structure. The keycap is disposed on the covering structure. The connecting element is connected between the covering structure and the pedestal structure. The keycap is movable upwardly or downwardly relative to the pedestal structure through the connecting element. The knocking element is supported on the connecting element. The dome-type elastomer is arranged between the covering structure and the membrane circuit board. The dome-type elastomer includes a contacting part. While the keycap is depressed and the covering structure is moved downwardly relative to the pedestal structure, the connecting element is firstly separated from the knocking element, then the knocking element knocks on the connecting element to generate a sound, and the dome-type elastomer is compressed by the covering structure, so that the membrane switch is pushed by the contacting part. When the keycap is not depressed, the covering structure is moved in response to an elastic force of the dome-type elastomer, so that the keycap is returned to an original position.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
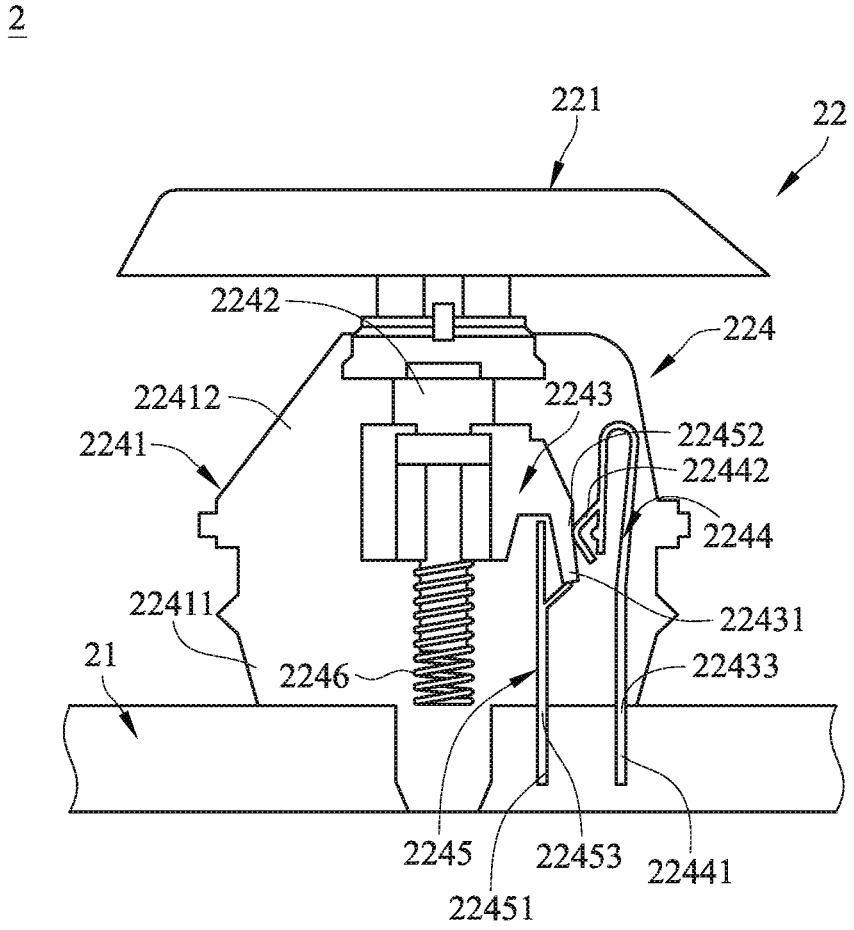
FIG.1 PRIOR ART
FIG. 1 is a schematic cross-sectional view illustrating a conventional keyboard device with a mechanical key structure.
Figure 2:
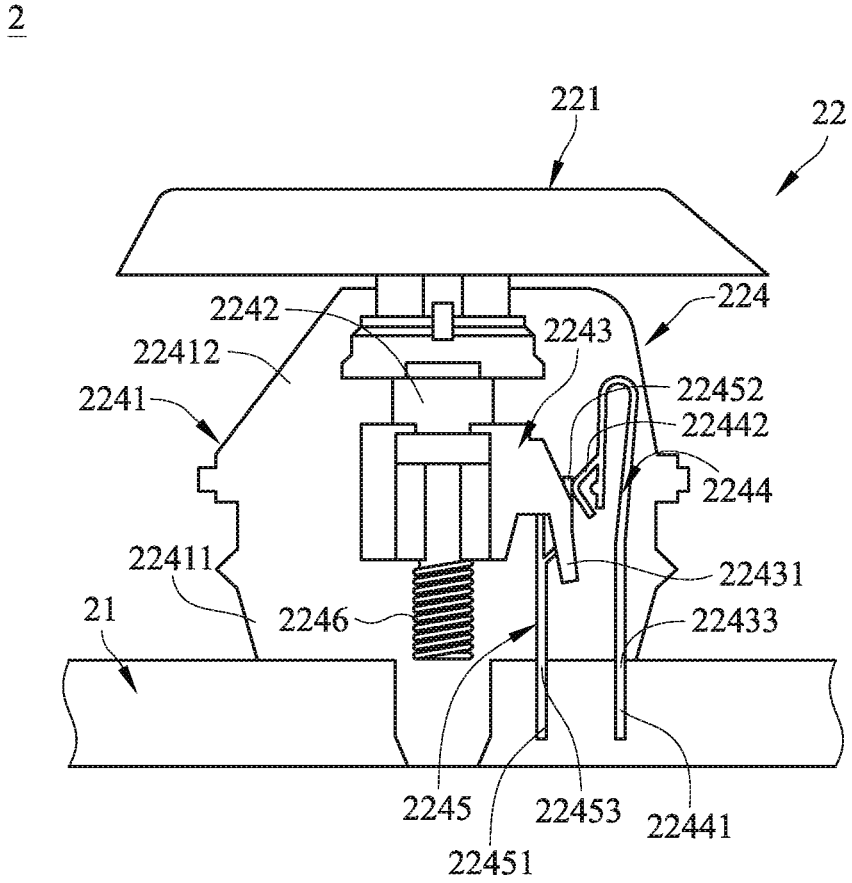
FIG.2 PRIOR ART
FIG. 2 is a schematic cross-sectional view illustrating the mechanical switch of the conventional keyboard device of FIG. 1, in which a keycap of the mechanical key structure is depressed.
Figure 3:
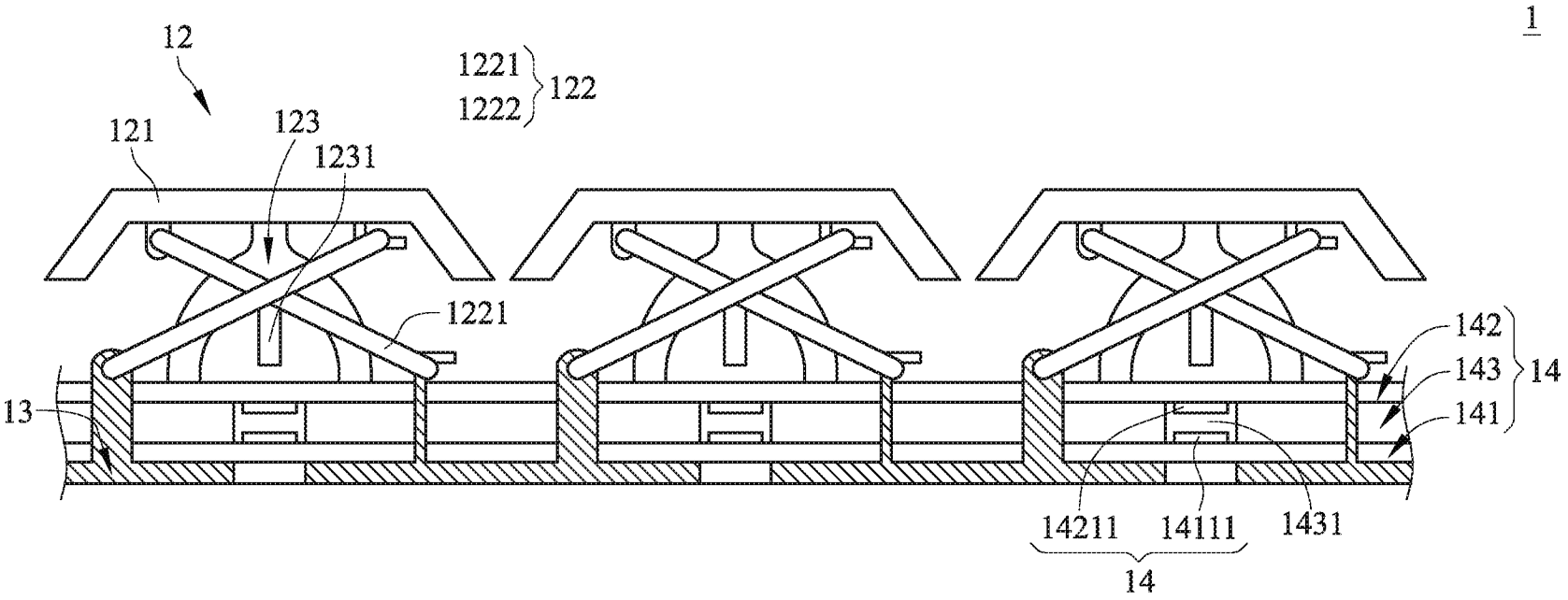
FIG.3 PRIOR ART
FIG. 3 is a schematic side view illustrating a conventional keyboard device with a membrane switch.
Figure 4:
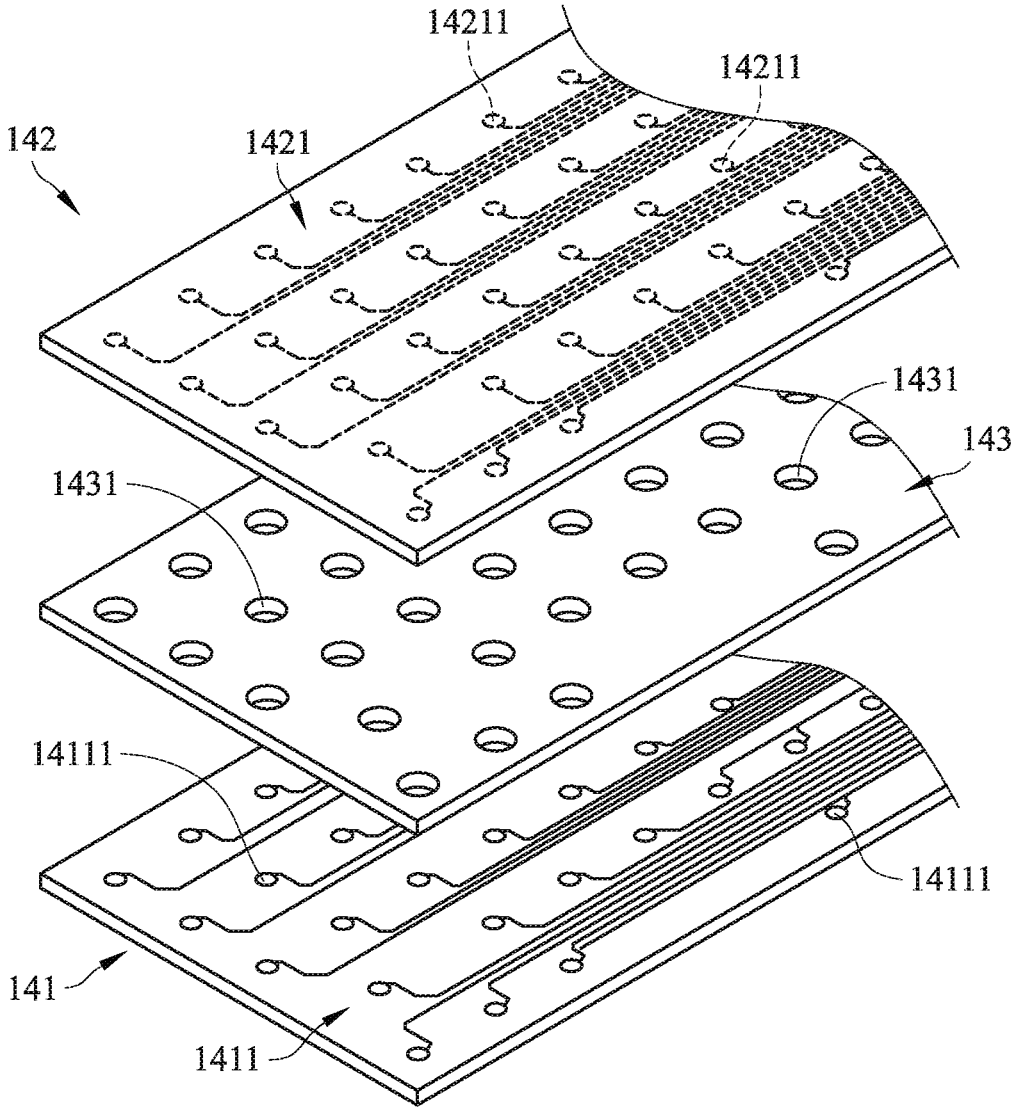
FIG.4 PRIOR ART
FIG. 4 is a schematic exploded view illustrating a portion of a membrane circuit board of the conventional keyboard device of FIG. 3.

The embodiments of present invention will be described more specifically with reference to the following drawings. Generally, in the drawings and specifications, identical or similar components are designated by identical numeral references. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 5:
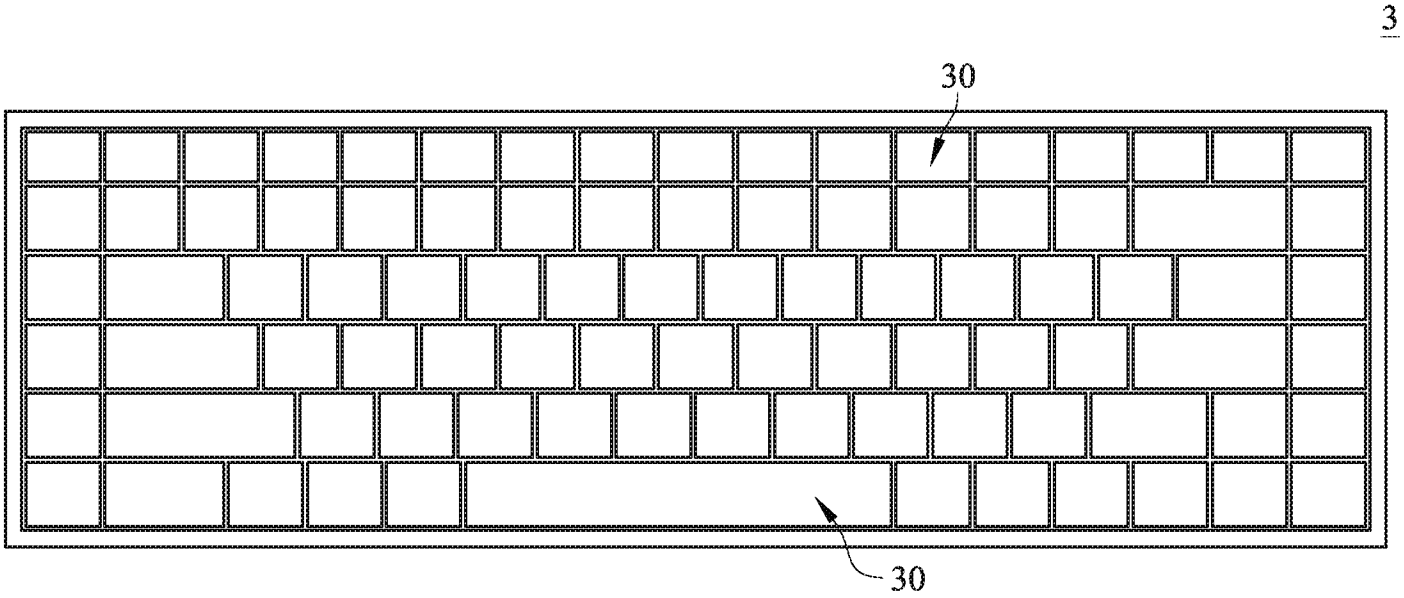
FIG. 5 is a schematic top view illustrating the appearance of a keyboard device according to a first embodiment of the present invention.
Figure 6:
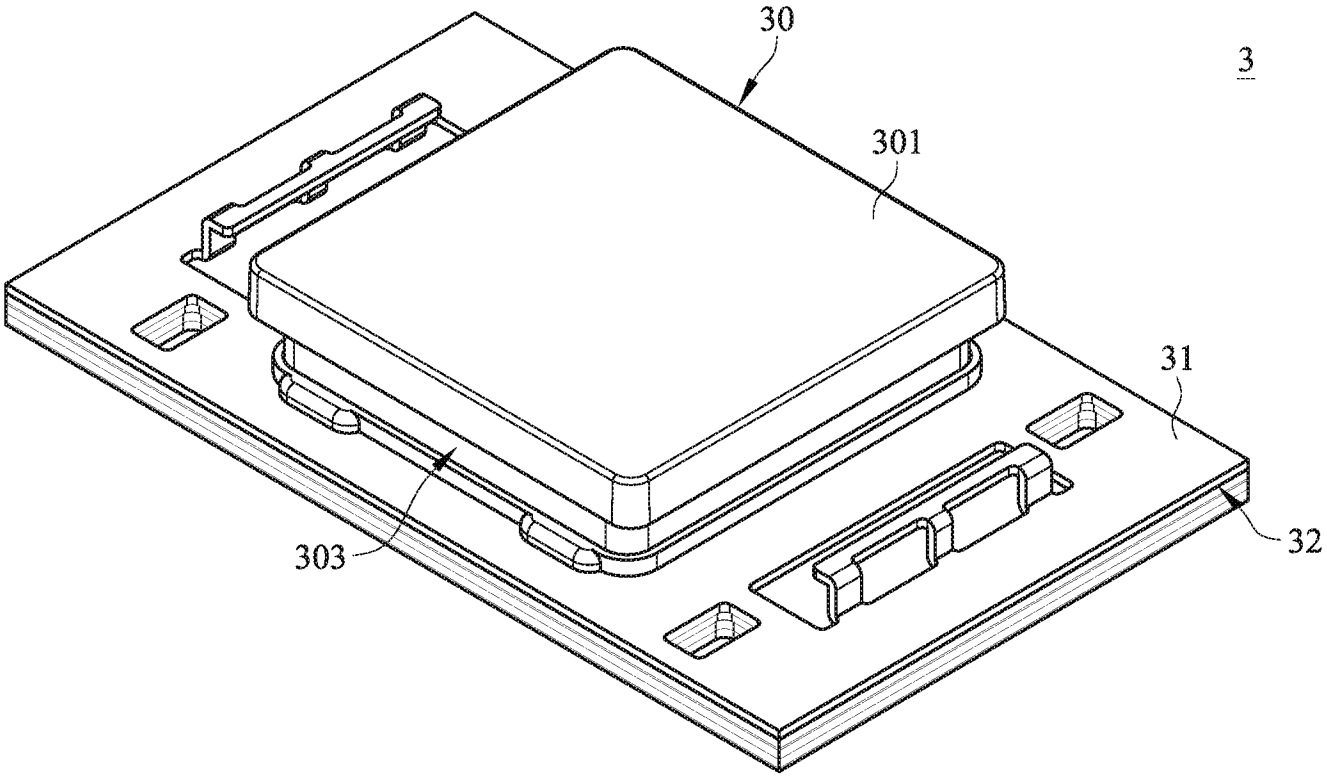
FIG. 6 is a schematic perspective view illustrating a portion of the keyboard device as shown in FIG. 5.

Please refer to FIGS. 5 and 6. FIG. 5 is a schematic top view illustrating the appearance of a keyboard device according to a first embodiment of the present invention. FIG. 6 is a schematic perspective view illustrating a portion of the keyboard device as shown in FIG. 5. For succinctness, only one key structure and associated components are shown in FIG. 6. The keyboard device 3 comprises plural key structures 30, a base plate 31 and a membrane circuit board 32. The base plate 31 is a metal plate and located over the membrane circuit board 32. It is noted that the material of the base plate 31 is not restricted. These key structures 30 are classified into some types, e.g., ordinary keys, numeric keys and function keys. When one of the key structures 30 is depressed by the user's finger, the keyboard device 3 generates a corresponding key signal to the computer, and thus the computer executes a function corresponding to the depressed key structure 30. For example, when an ordinary key is depressed, a corresponding English letter or symbol is inputted into the computer. When a numeric key is depressed, a corresponding number is inputted into the computer. In addition, the function keys (F1-F12) can be programmed to provide various quick access functions.

Figure 7:
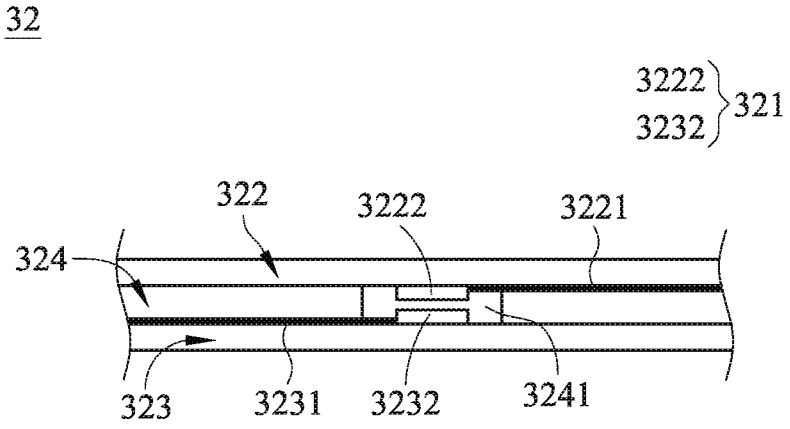
FIG. 7 is a schematic cross-sectional view illustrating a portion of the membrane circuit board of the keyboard device as shown in FIG. 6.

The membrane circuit board 32 comprises plural film layers. The plural film layers of the membrane circuit board 32 are arranged in a stack form. FIG. 7 is a schematic cross-sectional view illustrating a portion of the membrane circuit board of the keyboard device as shown in FIG. 6. The thickness of each film layer is presented herein for purpose of illustration and description only. For succinctness, only one upper contact, one lower contact and one perforation are shown in FIG. 7. In this embodiment, the plural film layers of the membrane circuit board 32 include an upper film layer 322 and a lower film layer 323. A first circuit pattern 3221 is formed on a bottom surface of the upper film layer 322. The first circuit pattern 3221 comprises plural upper contacts 3222 corresponding to the plural key structures 30. A second circuit pattern 3231 is formed on a top surface of the lower film layer 323. The second circuit pattern 3231 comprises plural lower contacts 3232 corresponding to the plural upper contacts 3222. Each of the upper contacts 3222 and the corresponding lower contact 3232 are separated from each other by a spacing interval. Moreover, each of the upper contacts 3222 and the corresponding lower contact 3232 are collectively defined as a membrane switch 321. For maintaining the spacing interval between each upper contact 3222 and the corresponding lower contact 3232, the membrane circuit board 32 further comprises an intermediate film layer 324. The intermediate film layer 324 is arranged between the upper film layer 322 and the lower film layer 323. In addition, the intermediate film layer 324 comprises plural perforations 3241 corresponding to the plural upper contacts 3222 and the plural lower contacts 3232. Preferably but not exclusively, at least one of the upper film layer 322, the lower film layer 323 and the intermediate film layer 324 is made of polycarbonate (PC), polyethylene terephthalate (PET), polymethylmethacrylate (PMMA), polyurethane (PU) or polyimide (PI).

Figure 8:
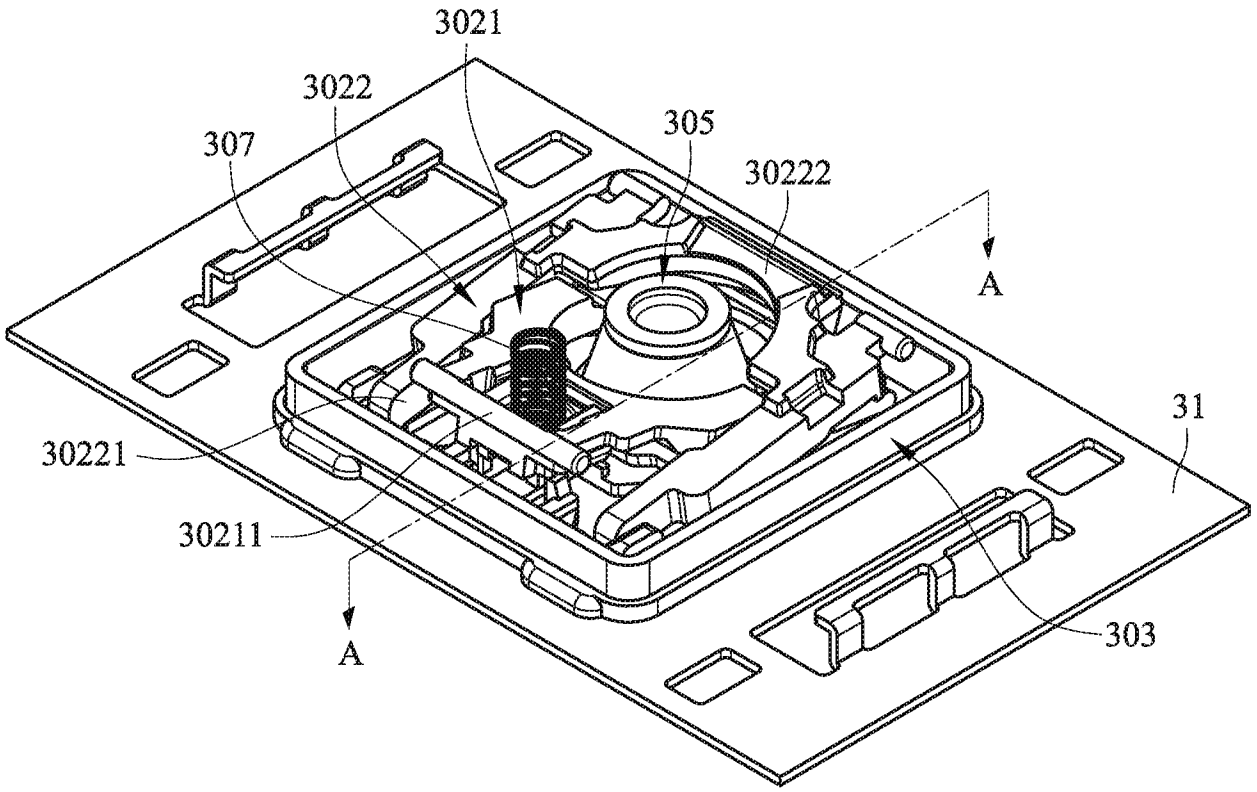
FIG. 8 is a schematic perspective view illustrating a portion of the keyboard device as shown in FIG. 6.
Figure 9:
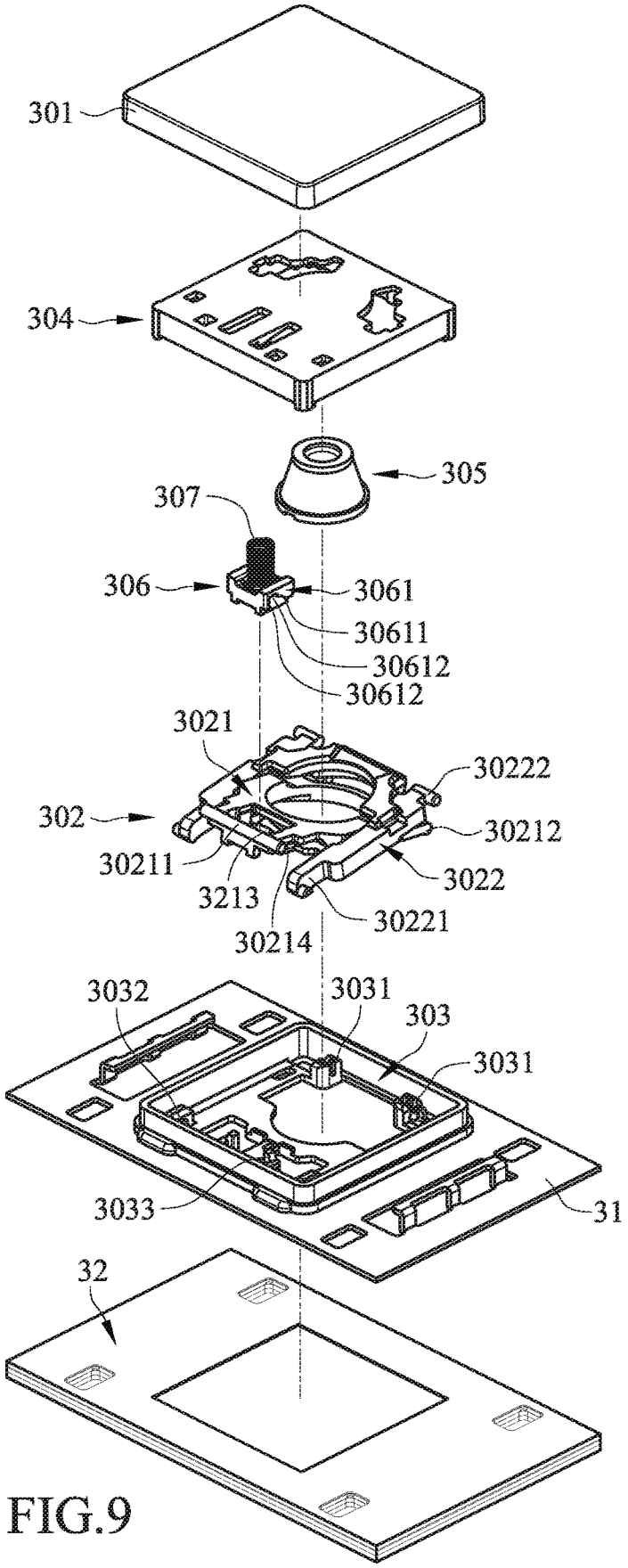
FIG. 9 is a schematic exploded view illustrating a portion of the keyboard device as shown in FIG. 6 and taken along a viewpoint.
Figure 10:
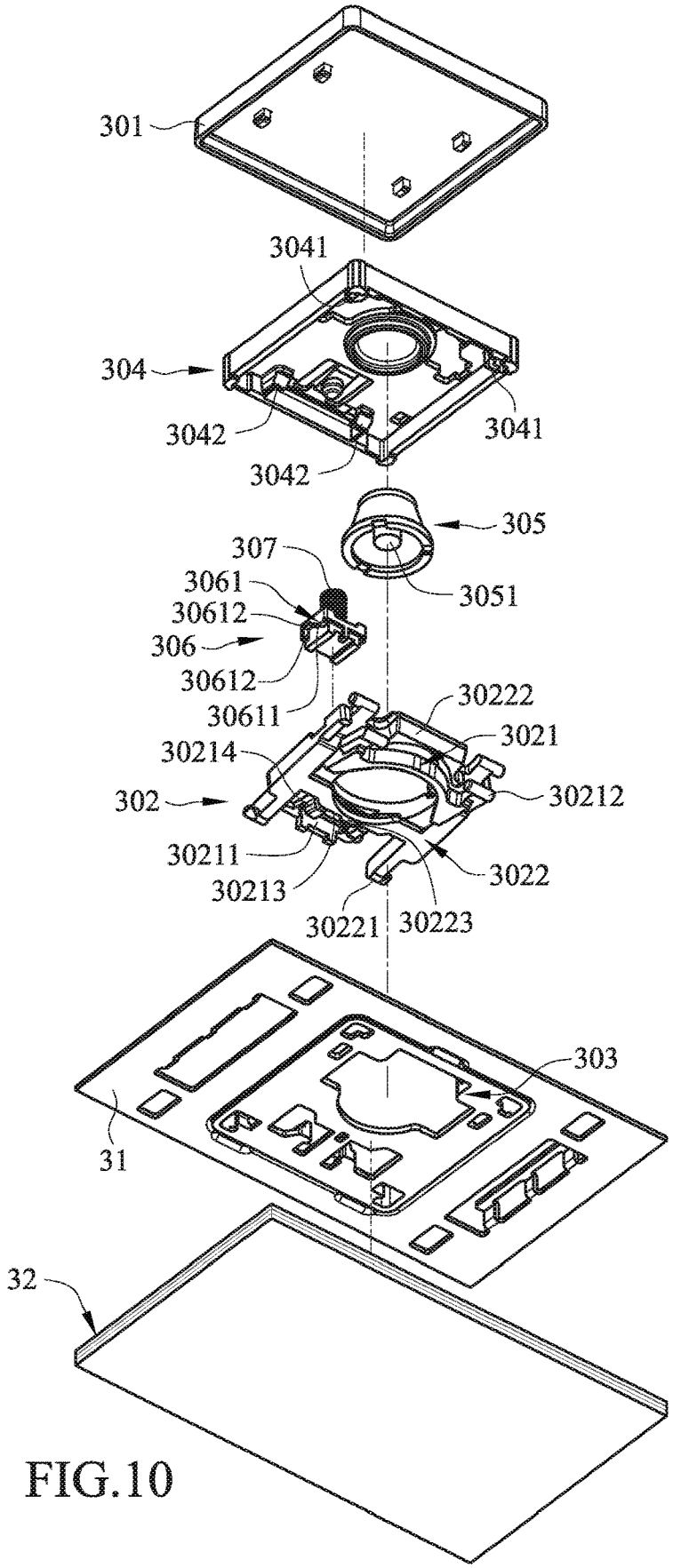
FIG. 10 is a schematic exploded view illustrating a portion of the keyboard device as shown in FIG. 6 and taken along another viewpoint.

Please refer to FIGS. 8, 9 and 10. FIG. 8 is a schematic perspective view illustrating a portion of the keyboard device as shown in FIG. 6. FIG. 9 is a schematic exploded view illustrating a portion of the keyboard device as shown in FIG. 6 and taken along a viewpoint. FIG. 10 is a schematic exploded view illustrating a portion of the keyboard device as shown in FIG. 6 and taken along another viewpoint. For succinctness, only one key structure and the associated components are shown in FIGS. 8, 9 and 10. In practice, the keyboard device comprises more than one key structure.

Each key structure 30 comprises a keycap 301, a connecting element 302, a pedestal structure 303, a covering structure 304 and a dome-type elastomer 305. The pedestal structure 303 is installed on the base plate 31. The connecting element 302 is connected between the covering structure 304 and the pedestal structure 303. Consequently, the covering structure 304 is movable upwardly and downwardly relative to the pedestal structure 303. The bottom part of the dome-type elastomer 305 is installed on the membrane circuit board 32. The top part of the dome-type elastomer 305 is sequentially penetrated through the base plate 31 and the connecting element 302 and contacted with the covering structure 304. Moreover, the dome-type elastomer 305 comprises a contacting part 3051. The contacting part 3051 faces the membrane switch 321. The keycap 301 is disposed on the covering structure 304, and the covering structure 304 is linked with the keycap 301. Preferably but not exclusively, the keycap 301 and the covering structure 304 are coupled with each other through an engaging means, and the pedestal structure 303 and the base plate 31 are coupled with each other through an engaging means.

Moreover, the covering structure 304 comprises at least one fixed hook 3041 and at least one movable hook 3042. The fixed hook 3041 and the movable hook 3042 are disposed on the bottom surface of the covering structure 304. In an embodiment, the connecting element 302 is a scissors-type connecting element. Moreover, the connecting element 302 comprises a first frame 3021 and a second frame 3022. The second frame 3022 is pivotally coupled to the first frame 3021. The first frame 3021 is an inner frame, and the second frame 3022 is an outer frame. The pedestal structure 303 comprises a pedestal bottom plate 3030, a first pedestal hook 3031 and a second pedestal hook 3032. The first pedestal hook 3031 and the second pedestal hook 3032 are protruded upwardly from the pedestal bottom plate 3030.

The first end 30211 of the first frame 3021 is connected to the movable hook 3042 of the covering structure 304 so as to be slidable relative to the covering structure 304. The second end 30212 of the first frame 3021 is pivotally connected to the first pedestal hook 3031 of the pedestal structure 303 so as to be rotatable relative to the pedestal structure 303. The first end 30221 of the second frame 3022 is connected with the second pedestal hook 3032 of the pedestal structure 303 so as to be slidable relative to the pedestal structure 303. The second end 30222 of the second frame 3022 is pivotally coupled to the fixed hook 3041 of the cover 304 so as to be rotatable relative to the covering structure 304. Due to the above structure, the first frame 3021 and the second frame 3022 can be swung relative to each other. Consequently, the first frame 3021 and the second frame 3022 are switched from a stacked state to an open-scissors state or switched from the open-scissors state to the stacked state. The connecting relationships between the connecting element 302, the covering structure 304 and the pedestal structure 303 are presented herein for purpose of illustration and description only.

The operations of the keyboard device 3 will be described as follows. While the keycap 301 of any key structure 30 is depressed and the covering structure 304 is moved downwardly relative to the pedestal structure 303, the first frame 3021 and the second frame 3022 of the connecting element 302 are switched from the open-scissors state to the stacked state. Moreover, while the covering structure 304 is moved downwardly to compress the dome-type elastomer 305, the corresponding upper contact 3222 of the membrane circuit board 32 is pushed and triggered by the contacting part 3051 of the dome-type elastomer 305. Consequently, the corresponding upper contact 3222 is contacted with the corresponding lower contact 3232 through the corresponding perforation 3241. In such way, the corresponding membrane switch 321 is electrically conducted, and the keyboard device 3 generates a corresponding key signal.

When the keycap 301 of the key structure 30 is no longer depressed, the covering structure 304 is moved upwardly relative to the pedestal structure 303 in response to an elastic force of the dome-type elastomer 305. Meanwhile, the first frame 3021 and the second frame 3022 are switched from the stacked state to the open-scissors state again, and the covering structure 304 and the keycap 301 are returned to its original position.

In an embodiment, the key structure 30 further comprises a knocking element 306. When the keycap 301 is not depressed, the knocking element 306 is supported on the connecting element 302. After the keycap 301 is depressed, the connecting element 302 is firstly separated from the knocking element 306. As the keycap 301 is continuously moved downwardly, the knocking element 306 knocks on the connecting element 302 to generate a sound.

Figure 11:
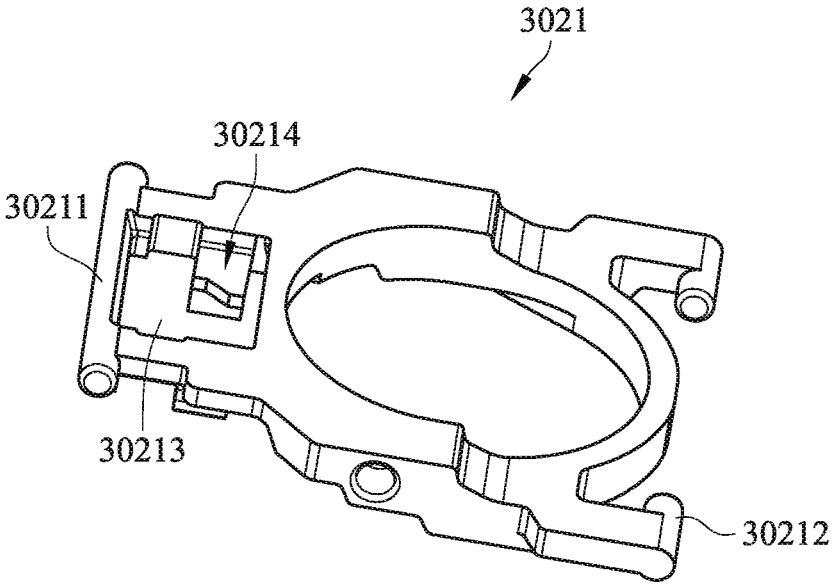
FIG. 11 is a schematic perspective view illustrating the first frame of the connecting element of the keyboard device as shown in FIG. 8.
Figure 12:
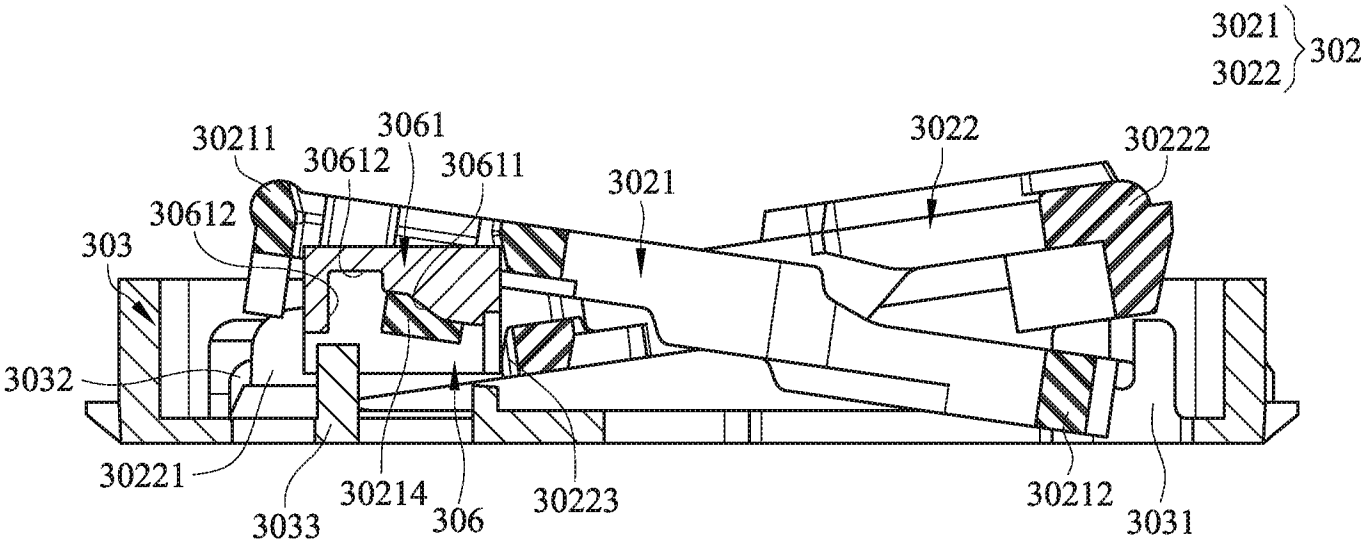
FIG. 12 is a schematic cross-sectional view illustrating a portion of the keyboard device as shown in FIG. 6 and taken along a line AA.

Please refer to FIGS. 8, 9, 10, 11 and 12. FIG. 11 is a schematic perspective view illustrating the first frame of the connecting element of the keyboard device as shown in FIG. 8. FIG. 12 is a schematic cross-sectional view illustrating a portion of the keyboard device as shown in FIG. 6 and taken along a line AA. For succinctness, only the connecting element 302, the pedestal structure 303 and the knocking element 306 are shown in FIG. 12. In an embodiment, the first end 30211 of the first frame 3021 comprises an accommodation hole 30213 and a supporting structure 30214. The supporting structure 30214 is protruded downwardly from the periphery of the accommodation hole 30213. The knocking element 306 is received within the accommodation hole 30213 of the first frame 3021. In addition, the knocking element 306 is movable upwardly or downwardly relative to the accommodation hole 30213. The knocking element 306 comprises a hangable part 3061. The hangable part 3061 is protruded from an external side of the knocking element 306. The hangable part 3061 has a stopping surface 30611 and a knocking surface 30612. The knocking surface 30612 is connected with the stopping surface 30611. When the keycap 301 is not depressed, the knocking surface 30612 of the hangable part 3061 is contacted with the supporting structure 30214 of the first frame 3021. Consequently, the knocking element 306 is hung on the supporting structure 30214.

In an embodiment, the key structure 30 further comprises a spring 307. The spring 307 is arranged between the covering structure 304 and the knocking element 306. The pedestal structure 303 further comprises a stopping post 3033. The stopping post 3033 is located near an underlying position of the supporting structure 30214 of the first frame 3021 and protruded upwardly from the pedestal bottom plate 3030. Moreover, a push structure 30223 is formed on an inner surface of the first end 30221 of the second frame 3022 of the connecting element 302. When the keycap 301 is not depressed, the push structure 30223 is located near a lateral side of the knocking element 306.

Figure 13:
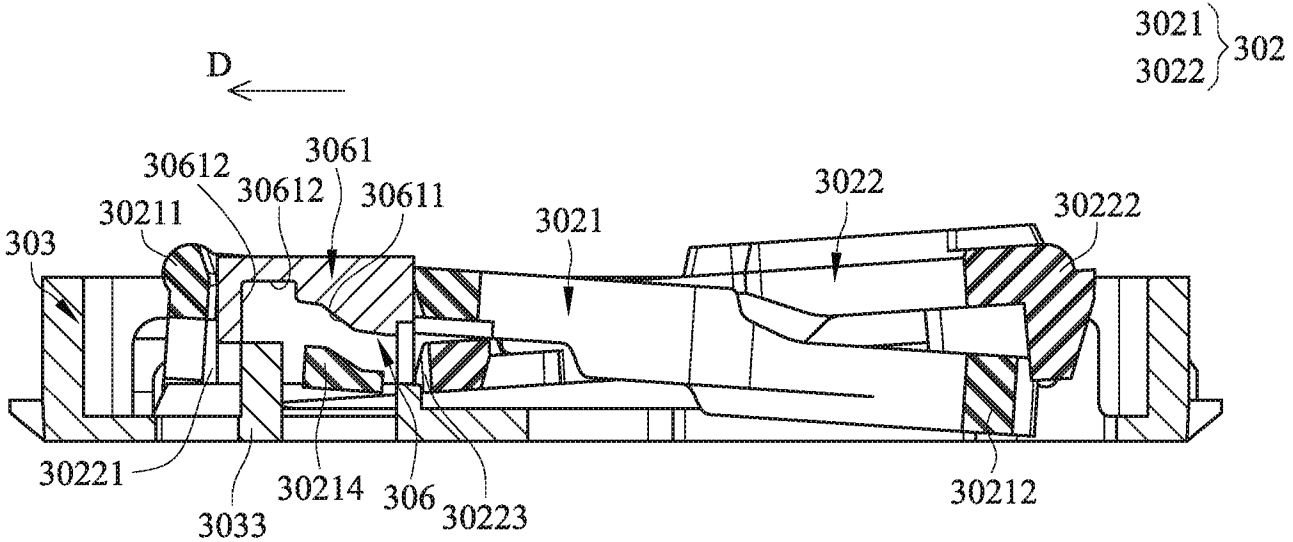
FIG. 13 is a schematic cross-sectional view illustrating a portion of the keyboard device as shown in FIG. 12, in which the keycap is depressed in a first stage.
Figure 14:
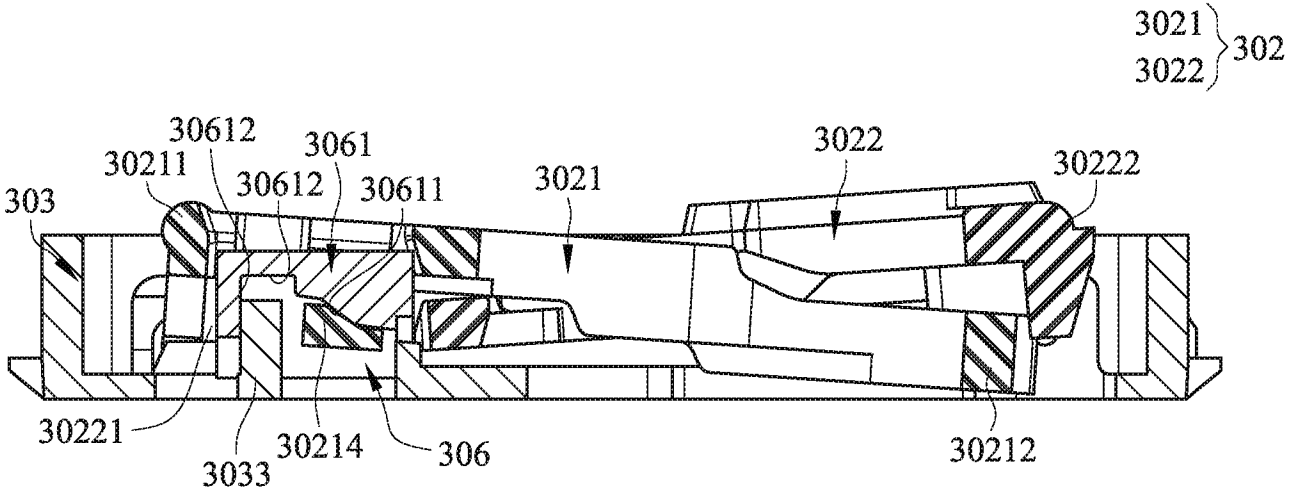
FIG. 14 is a schematic cross-sectional view illustrating a portion of the keyboard device as shown in FIG. 12, in which the keycap is depressed in a second stage.
Figure 15:
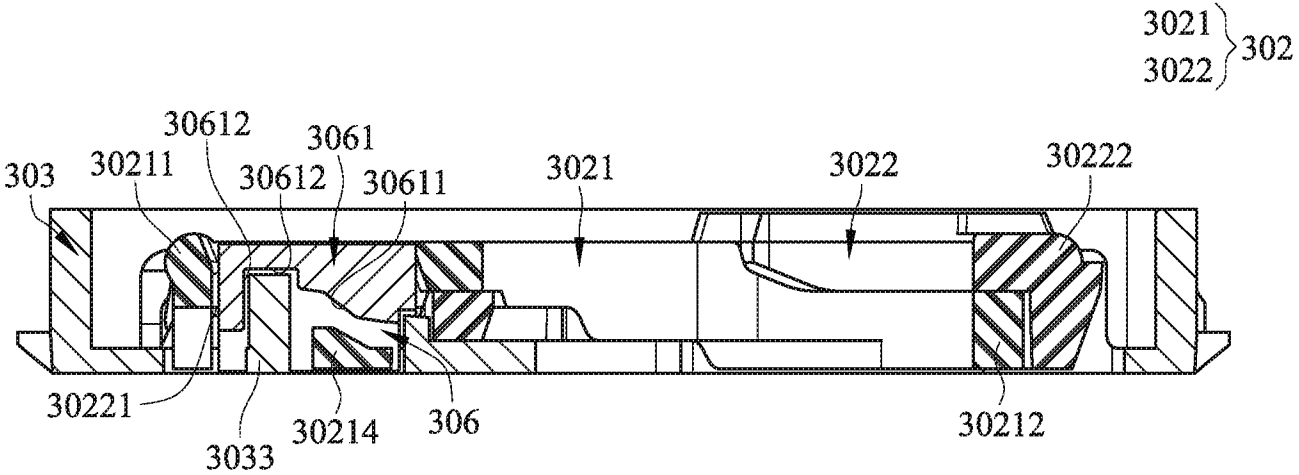
FIG. 15 is a schematic cross-sectional view illustrating a portion of the keyboard device as shown in FIG. 12, in which the keycap is depressed in a third stage.

Hereinafter, the operations of the keyboard device 3 to generate the operating sound will be described with reference to FIGS. 13, 14 and 15. FIG. 13 is a schematic cross-sectional view illustrating a portion of the keyboard device as shown in FIG. 12, in which the keycap is depressed in a first stage. FIG. 14 is a schematic cross-sectional view illustrating a portion of the keyboard device as shown in FIG. 12, in which the keycap is depressed in a second stage. FIG. 15 is a schematic cross-sectional view illustrating a portion of the keyboard device as shown in FIG. 12, in which the keycap is depressed in a third stage. For succinctness, only the connecting element 302, the pedestal structure 303 and the knocking element 306 are shown in FIGS. 13, 14 and 15.

While the keycap 301 is depressed, the first end 30211 of the first frame 3021 is externally slid relative to the covering structure 304, and the supporting structure 30214 of the first frame 3021 is moved downwardly. Consequently, the supporting structure 30214 of the first frame 3021 is separated from the knocking element 306. At the same time, the first end 30221 of the second frame 3022 is externally slid relative to the pedestal structure 303. Consequently, the push structure 30223 of the second frame 3022 is correspondingly moved in the direction D1 to push the knocking element 306. In addition, the stopping surface 30611 of the hangable part 3061 of the knocking element 306 is aligned with the stopping post 3033 (see FIG. 13).

Please refer to FIG. 14. As mentioned above, the spring 307 is arranged between the covering structure 304 and the knocking element 306 is compressed. The spring 307 provides an elastic force to the knocking element 306. In response to the elastic force and due to the cooperation between the stopping surface 30611 the knocking element 306 and the stopping post 3033 of the pedestal structure 303, the knocking element 306 is correspondingly moved downwardly to knock on the supporting structure 30214 of the first frame 3021. Consequently, the knocking sound and the operating feedback are generated.

Then, keycap 301 is pressed down to the bottommost position. The cooperation between the stopping surface 30611 the knocking element 306 and the stopping post 3033 of the pedestal structure 303 facilitates positioning the knocking element 306. Meanwhile, the first frame 3021 and the second frame 3022 are in the completely stacked state.

From the above descriptions, the keyboard device is equipped with the membrane circuit board. Consequently, the keyboard device is slim and has reduced fabricating cost. The key structure comprises the knocking element. As the keycap is moved downwardly, the knocking element is moved upwardly to knock on the connecting element. Consequently, the keyboard device provides the operating sound and the operating feedback like a mechanical switch. The key structure further comprises the dome-type elastomer to support the covering structure and provide the elastic force to the covering structure. Since the keycap is installed on the covering structure, the better periphery tactile feel and stepped operating feel can be provided. In other words, the keyboard device of the present invention is industrially valuable. The keyboard device is suitably applied to an electronic sports product, e.g., a keyboard device for the electronic sports game.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising: a membrane circuit board comprising a membrane switch; and a key structure corresponding to the membrane switch, wherein the key structure comprises: a pedestal structure located over the membrane circuit board; a covering structure movable upwardly or downwardly relative to the pedestal structure; a keycap disposed on the covering structure; a connecting element connected between the covering structure and the pedestal structure, wherein the keycap is movable upwardly or downwardly relative to the pedestal structure through the connecting element; a knocking element supported on the connecting element; and a dome-type elastomer arranged between the covering structure and the membrane circuit board, wherein the dome-type elastomer comprises a contacting part, wherein while the keycap is depressed and the covering structure is moved downwardly relative to the pedestal structure, the connecting element is firstly separated from the knocking element, then the knocking element knocks on the connecting element to generate a sound, and the dome-type elastomer is compressed by the covering structure, so that the membrane switch is pushed by the contacting part, wherein when the keycap is not depressed, the covering structure is moved in response to an elastic force of the dome-type elastomer, so that the keycap is returned to an original position, wherein the connecting element comprises an accommodation hole, wherein the knocking element is received within the accommodation hole, and the knocking element is movable upwardly or downwardly relative to the accommodation hole.

2. The keyboard device according to claim 1, wherein the membrane circuit board further comprises an upper film layer and a lower film layer, wherein a first circuit pattern is formed on the upper film layer, a second circuit pattern is formed on the lower film layer, the first circuit pattern comprises an upper contact, and the second circuit pattern comprises a lower contact, wherein the upper contact and the lower contact are separated from each other by a spacing distance and collectively defined as the membrane switch.

3. The keyboard device according to claim 1, wherein the connecting element comprises a first frame and a second frame, wherein a first end of the first frame is connected with the covering structure and slidable relative to the covering structure, a second end of the first frame is pivotally coupled to the pedestal structure, wherein a second frame is connected with the first frame and swung relative to the first frame, a first end of the second frame is connected with the pedestal structure and slidable relative to the pedestal structure, and a second end of the second frame is pivotally coupled to the covering structure.

4. The keyboard device according to claim 1, wherein the first end of the first frame further comprises a supporting structure, and the supporting structure is protruded downwardly from a periphery of the accommodation hole, wherein when the keycap is not depressed, the knocking element is hung on the supporting structure.

5. The keyboard device according to claim 4, wherein the knocking element comprises a hangable part, and the hangable part is protruded from an external side of the knocking element, wherein the knocking element is hung on the supporting structure through the hangable part.

6. The keyboard device according to claim 5, wherein the hangable part comprises a stopping surface and a knocking surface, and the knocking surface is connected with the stopping surface, wherein the pedestal structure comprises a stopping post, and the stopping post is protruded upwardly, wherein when the keycap is not depressed, the knocking surface is supported by the supporting structure, so that the knocking element is hung on the supporting structure, wherein while the keycap is depressed, the stopping surface cooperates with the stopping post, so that the knocking element is moved downwardly and positioned, wherein while the knocking element is moved downwardly, the stopping surface knocks on the supporting structure.

7. The keyboard device according to claim 6, wherein a push structure is formed on the first end of the second frame, wherein when the keycap is depressed and the first end of the second frame is slid relative to the pedestal structure, the push structure is moved to push the knocking element, so that the stopping surface is aligned with the stopping post.

8. The keyboard device according to claim 1, wherein the key structure further comprises a spring, and the spring is arranged between the covering structure and the knocking element, wherein while the keycap is depressed, the knocking element knocks on the connecting element in response to an elastic force of the spring.

9. The keyboard device according to claim 1, wherein the keyboard device further comprises a base plate, wherein the base plate is installed on the membrane circuit board, and the pedestal structure is installed on the base plate.

* * * * *